US009732549B2

(12) United States Patent
Chow

(10) Patent No.: US 9,732,549 B2
(45) Date of Patent: Aug. 15, 2017

(54) SAFE WITH CONCEALED HINGE

(76) Inventor: Leslie Ho Leung Chow, Shilouzhen Panyu District (CN)

( * ) Notice: Subject to any disclaimer, the term of this patent is extended or adjusted under 35 U.S.C. 154(b) by 0 days.

(21) Appl. No.: 12/902,750

(22) Filed: Oct. 12, 2010

(65) Prior Publication Data

US 2012/0085272 A1 Apr. 12, 2012

(51) Int. Cl.
*E05G 1/026* (2006.01)
*E05D 7/14* (2006.01)

(52) U.S. Cl.
CPC ..... *E05G 1/026* (2013.01); *E05D 7/14* (2013.01); *E05Y 2900/132* (2013.01)

(58) Field of Classification Search
USPC ..... 109/59 R, 59 T, 64, 73
See application file for complete search history.

(56) References Cited

U.S. PATENT DOCUMENTS 1,048,038 A * 12/1912 Cerny ..... 49/398
1,605,296 A * 11/1926 Silvers ..... 16/375
4,704,970 A * 11/1987 Sanderson et al. ..... 109/73
5,769,006 A * 6/1998 Allaer ..... 109/73
5,971,515 A * 10/1999 Baker et al. ..... 312/329
7,350,470 B1 * 4/2008 Stuhlbarg et al. ..... 109/73
7,721,389 B2 * 5/2010 Wildman ..... 16/387
7,836,555 B2 * 11/2010 Wildman ..... 16/387
7,975,433 B2 * 7/2011 Dunstan ..... 49/254

* cited by examiner

*Primary Examiner* — Christopher Boswell
(74) *Attorney, Agent, or Firm* — John R. Ross; John R. Ross, III

(57) ABSTRACT

A safe with a concealed hinge assembly. A safe body has a pocket with a hinge pin attached to the pocket. A safe door has a hinge lug rigidly attached to the safe door. A hinge assembly is formed when the hinge pin is inserted through the hinge lug allowing for the safe door to be pivotally attached to the safe body. The hinge assembly is contained within the pocket so that the hinge assembly is concealed and protected from tampering. In a preferred embodiment the safe body includes two pockets within a rigidly attached door frame. Two hinge assemblies are contained within the pockets so that they are concealed and protected from tampering.

13 Claims, 9 Drawing Sheets

SAFE WITH CONCEALED HINGE

The present invention relates to safes, and in particular, to safe hinges.

BACKGROUND OF THE INVENTION

Safe boxes (also known as "safes") are well known in the prior art. They are used primarily to protect documents, currency, jewelry, and other valuables from fire and theft. Stand alone safes are very common in homes and businesses throughout the world. A good description of safes is given in U.S. Pat. No. 7,350,470, which is incorporated by reference herein.

As stated in the Background section of the '470 patent, safes typically are constructed of thick metal plates that form an inner compartment for housing the valuables. A door provides access to the inner compartment and a locking mechanism secures the door to the housing to prevent unauthorized entry into the safe interior. The locking mechanism is typically retaining rods that project from the door along inner surfaces into apertures on adjoining surfaces or vice versa. The rods may be maneuvered mechanically, hydraulically, electrically, or by other means, but are traditionally policed by a security mechanism built into the safe door. The security mechanism may be triggered by a numeric or alphanumeric code, a magnetic strip, a simple key, or any other means for storing a code or combination. The triggering device, such as a key or combination, permits the retaining rods to be withdrawn from the outside of the safe via a handle, thereby allowing access to the safe's interior. Safes come in many sizes and shapes, including floor safes, wall safes, stand-alone safes, and variations thereof.

A very important feature of a safe is its resistance to break-in. Because valuables and other important documents are traditionally stored in safes, they are always targets for thieves who try to pilfer the safe's contents. The very nature of the safe's construction, namely five walls and a door, emphasize the Achilles heel of most safes is the hinge at the juncture of the door with the adjoining walls. In particular, a would be thief who is without the access code required to open the safe without disabling it will tend not to attempt to penetrate the fixed walls. Rather, access can most easily be obtained by disabling an exposed hinge or coupling that connects the safe door to the housing. Because hinges are outside the safe and can be mechanically, chemically, or thermally disabled, the hinge is the focus of most safe break-ins. This is frustrating to safe owners and builders, who take great measures to provide sturdy, impenetrable walls and yet the strongest of safes can be defeated by simply disengaging the associated hinge member.

Unfortunately, in traditional safe design the hinge is positioned on the exterior of the safe and therefore exposed to mechanical or blunt force that can damage the hinge. In this way, thieves can often defeat the safe's theft protection characteristics by attacking the hinge which in turn allows the thief to gain access to the contents of the safe. The exposure of the safe door hinge prevents most prior art safes from being completely effective against break-in.

The '470 patent discloses a hinge assembly that includes hinge pins (referred to as pivot rods 120). However, the '470 safe discloses an exposed lug (referred to as hinge column 62) that is susceptible to tampering.

What is needed is a better safe hinge assembly having both a concealed hinge lug and hinge pin.

SUMMARY OF THE INVENTION

The present invention provides a safe with a concealed hinge assembly. A safe body includes a hinge pocket with a a spring loaded hinge pin located within the pocket. A safe door has a hinge lug rigidly attached to a side wall of the safe door. The hinge pocket in the safe body defines a pocket opening permitting attachment of the hinge lug to the hinge pin. The pocket opening is positioned so that the closing of the safe door causes the side wall of the safe door to cover the pocket opening. A hinge assembly is formed when the hinge pin is inserted through the hinge lug allowing the safe door to be pivotally attached to the safe body. With the door closed, the hinge assembly is completely contained within the pocket and the pocket is covered by the side wall of the safe door so that the hinge assembly is concealed and protected from tampering. In a preferred embodiment the safe body includes two hinge pockets within a rigidly attached door frame. In another preferred embodiment a single elongated hinge pocket is provided with pins at the top and bottom and the hinge lug is also an elongated hinge lug.

DETAILED DESCRIPTION OF THE PREFERRED EMBODIMENTS

Figure 1:
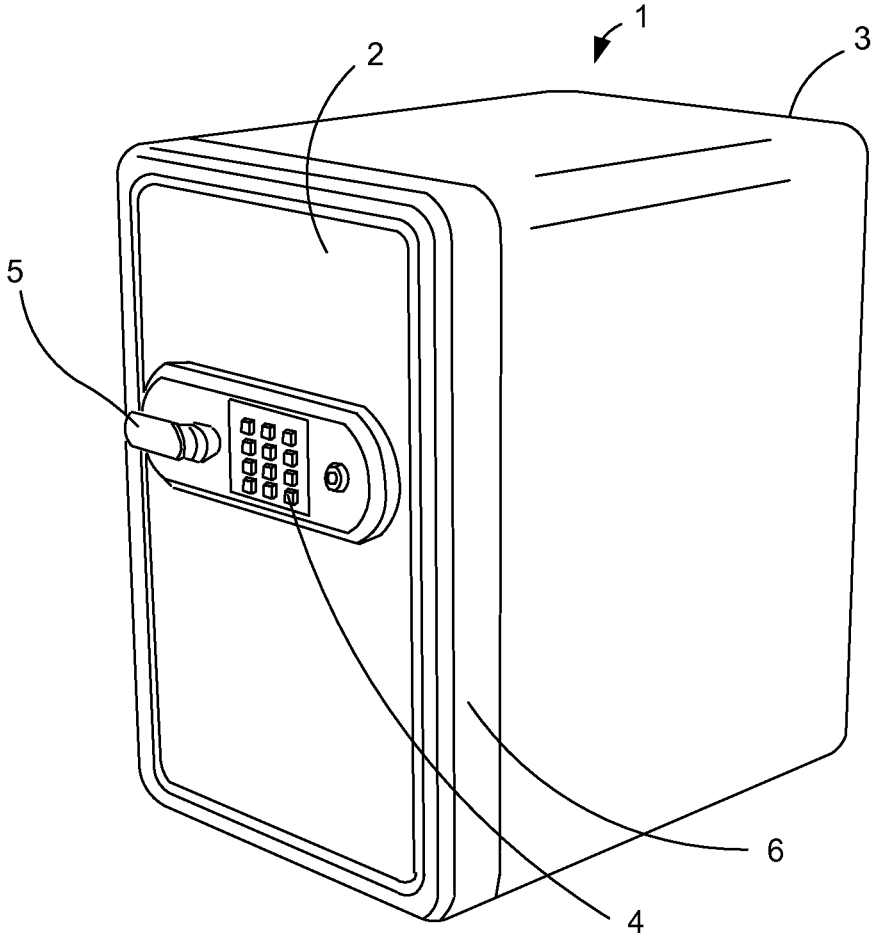
FIG. 1 shows a preferred embodiment of the present invention.

FIG. 1 shows a preferred embodiment of the present invention. FIG. 1 shows safe 1 with safe door 2 where safe door 2 is shut and locked. Safe door 2 covers and secures the opening to safe body 3. Door frame 6 is preferably welded to and is a part of safe body 3. Safe door 2 is opened by keying in the correct combination into keypad 4 and turning handle 5. As safe door 2 opens it pivots on a hinge assembly. As shown in FIG. 1, the hinge assembly is concealed. This allows for optimum security.

Door Frame

Figure 2:
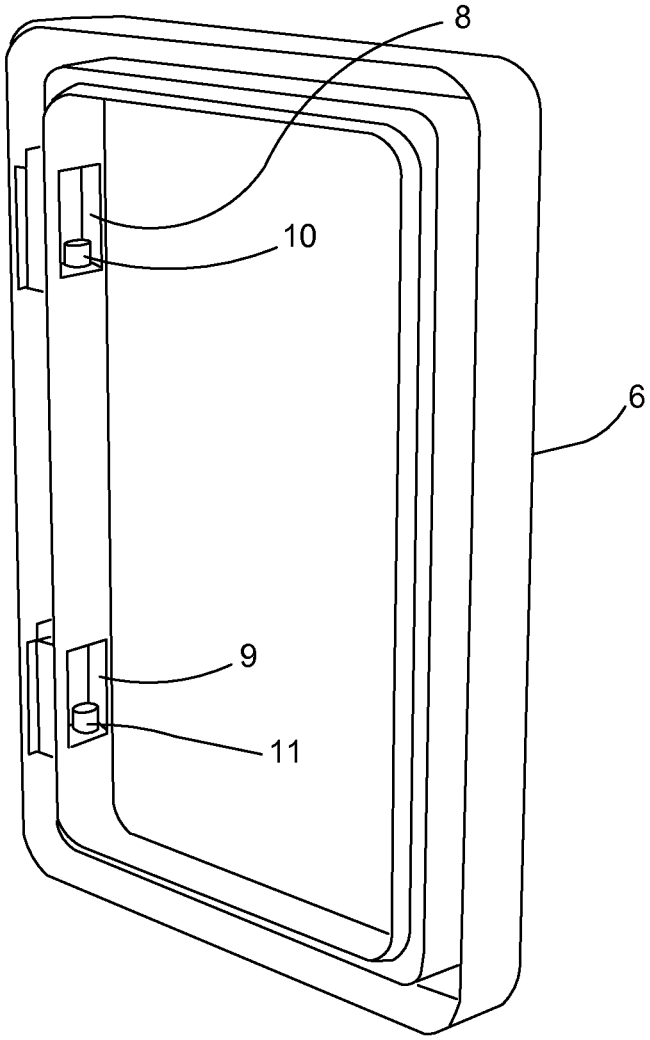
FIG. 2 shows a preferred door frame.
Figure 3:
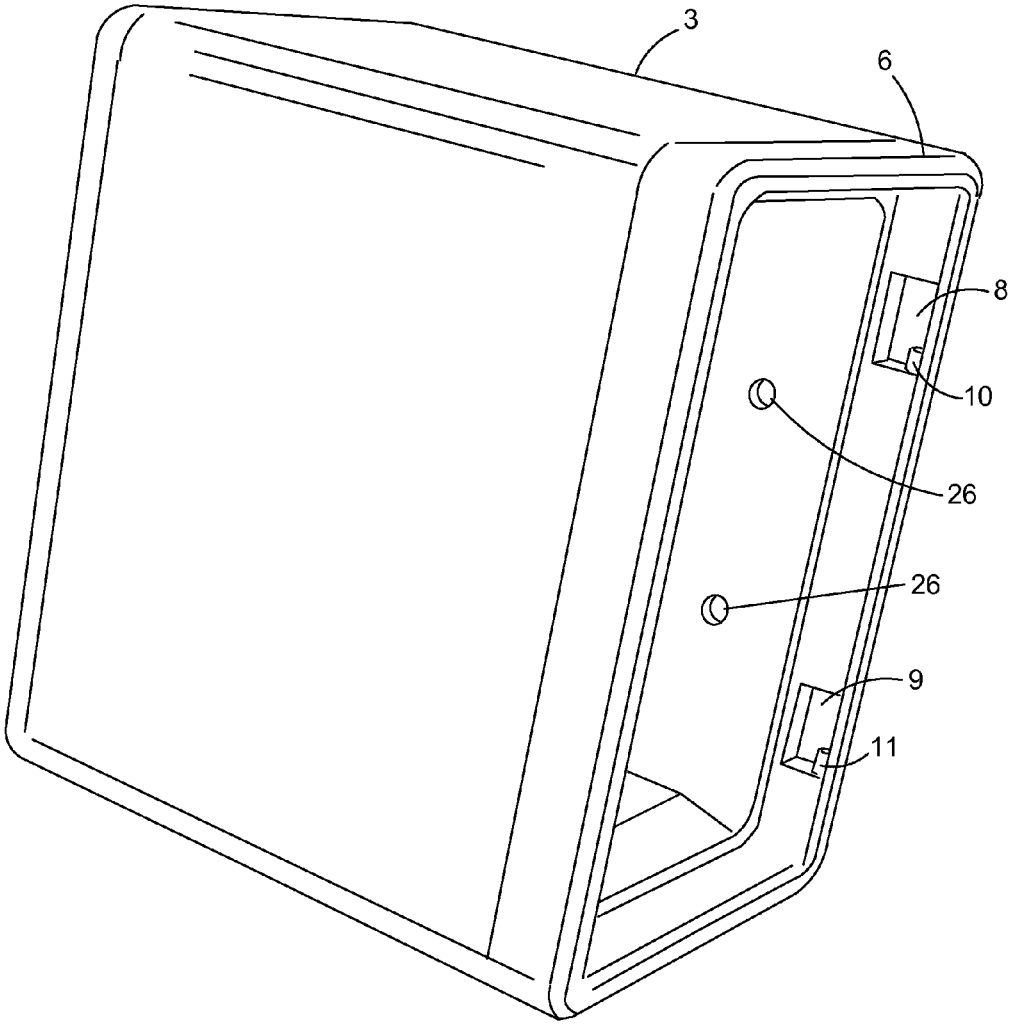
FIG. 3 shows a preferred door frame attached to a preferred safe body.

As shown in FIG. 2, door frame 6 includes two rigidly attached pockets 8 and 9. Pocket 8 includes spring loaded hinge pin 10 and pocket 9 includes spring loaded hinge pin 11. FIG. 3 shows a perspective view of frame 6 welded to safe body 3.

Safe Door

Figure 4:
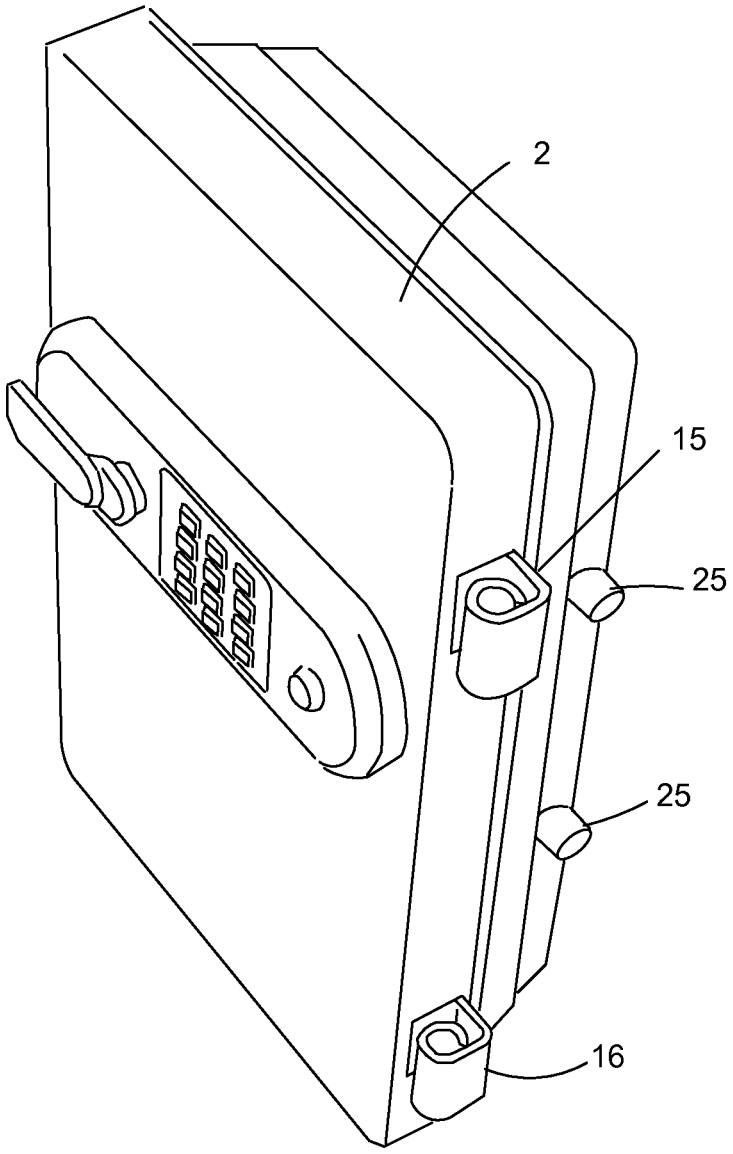
FIG. 4 shows a preferred safe door.

FIG. 4 shows a perspective view of safe door 2. Hinge lugs 15 and 16 are rigidly attached to door 2 as shown. When safe door 2 is connected to safe body 3, hinge pin 10 engages hinge lug 15 and hinge pin 11 engages hinge lug 16. Hinge pin 10 and hinge lug 15 form an upper concealed hinge 21 (FIG. 6) and hinge pin 11 and hinge lug 16 form a lower concealed hinge.

Operation of the Preferred Embodiment

Figure 5:
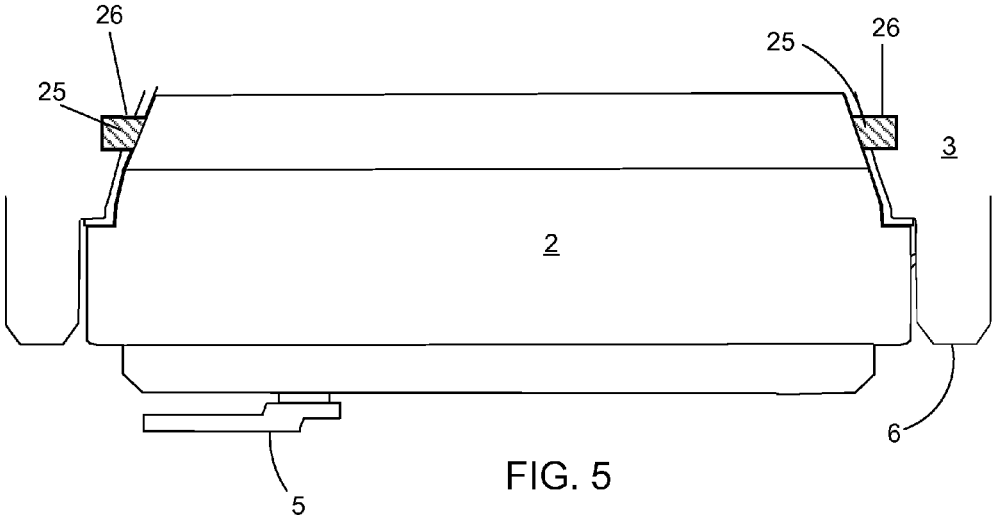
FIGS. 5-6 show a top view of a preferred embodiment of the present invention.

FIG. 5 shows a top view of safe door 2 connected to door frame 6 of safe body 3. Safe door 2 is shut and locked. The components of upper hinge 21 (hinge pin 10 and hinge lug 15) and the lower hinge (hinge pin 11 and hinge lug 16) are concealed within safe door frame 6. Handle 5 is horizontal and bolts 25 are inserted into recesses 26 (see also FIGS. 3 and 4) so that safe door 2 is locked.

Figure 6:
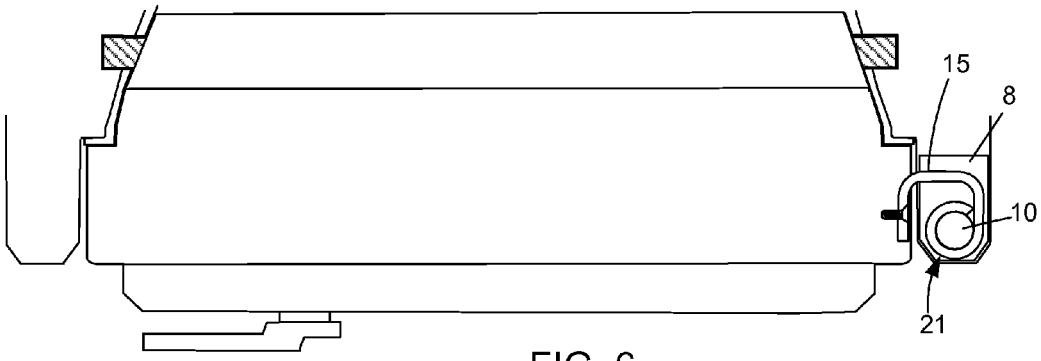

FIG. 6 shows a top view similar to the top view shown in FIG. 5. However, in FIG. 6 the drawing is see-through so that the upper hinge components are visible.

Figure 7:
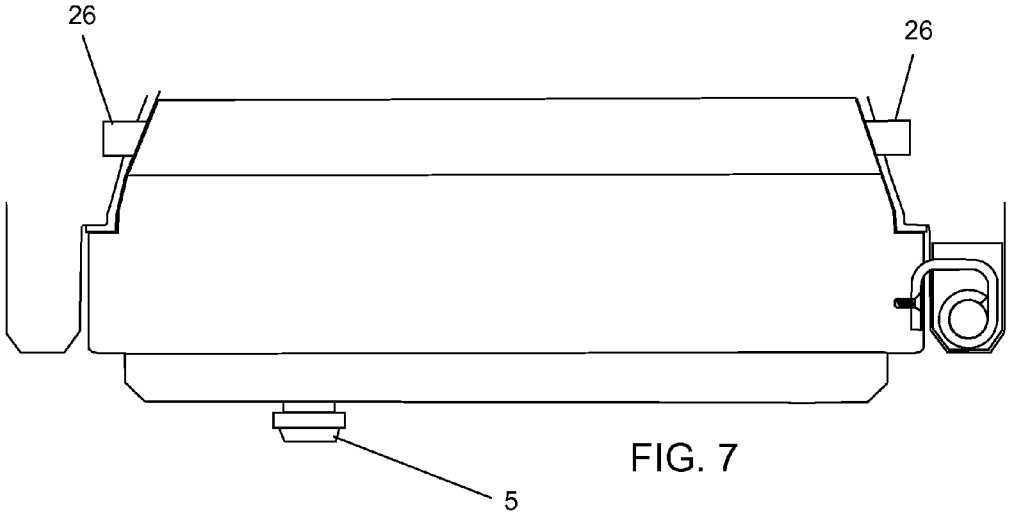
FIGS. 7-11 show the operation of a preferred embodiment of the present invention.
Figure 8:
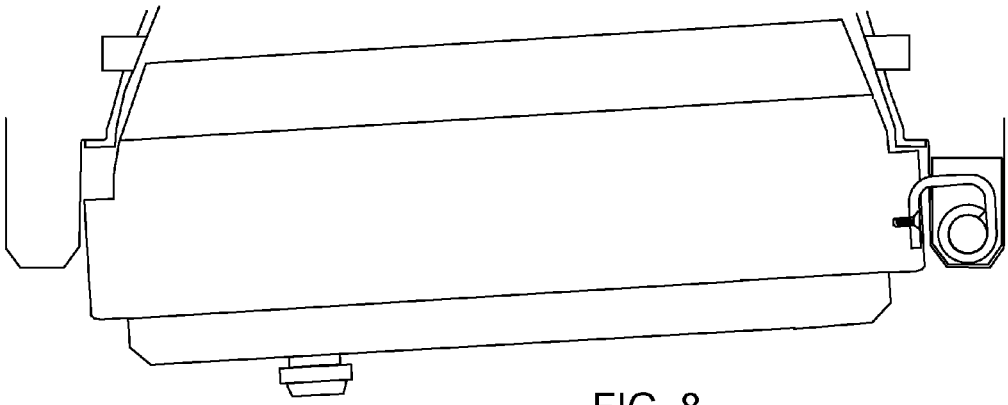
Figure 9:
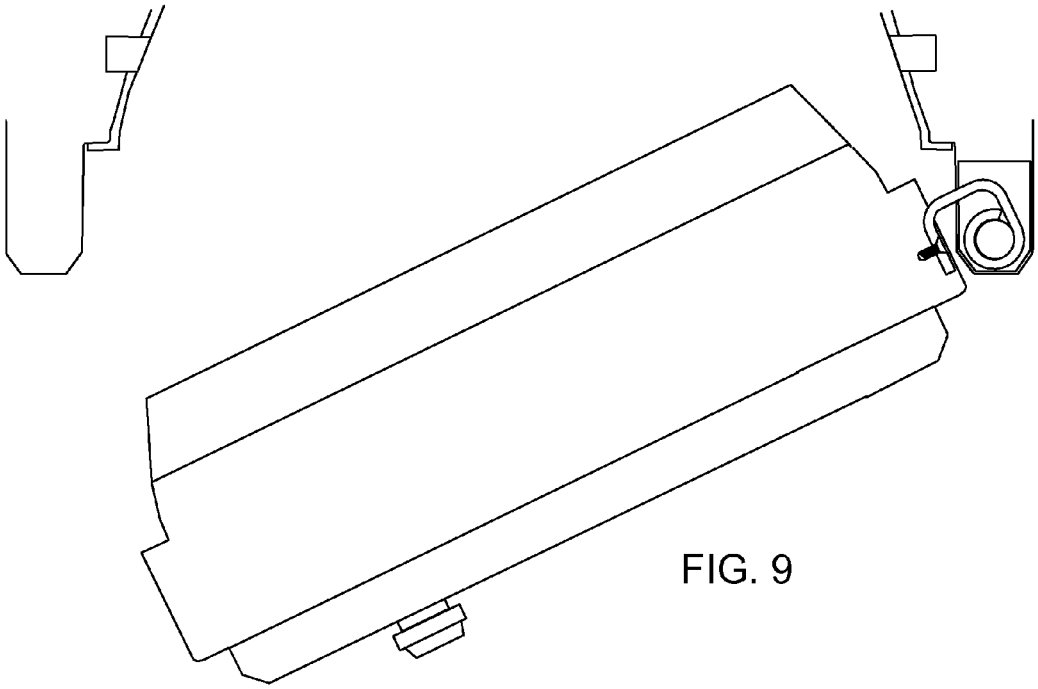
Figure 10:
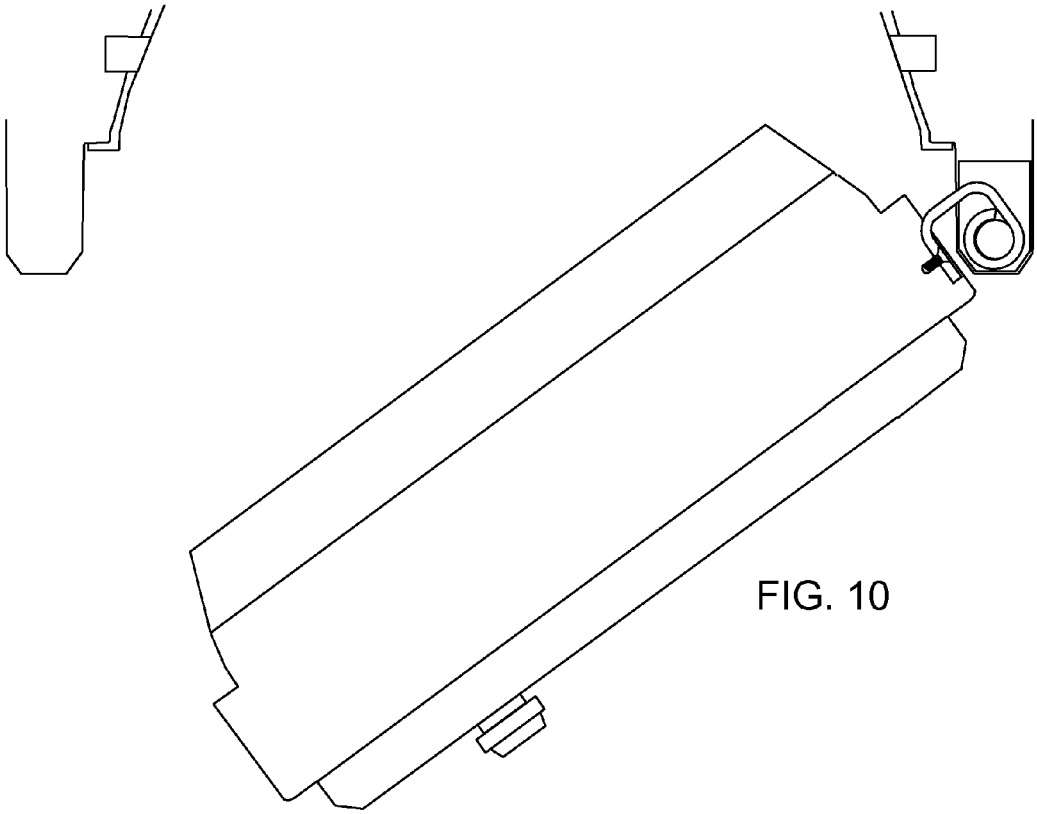
Figure 11:
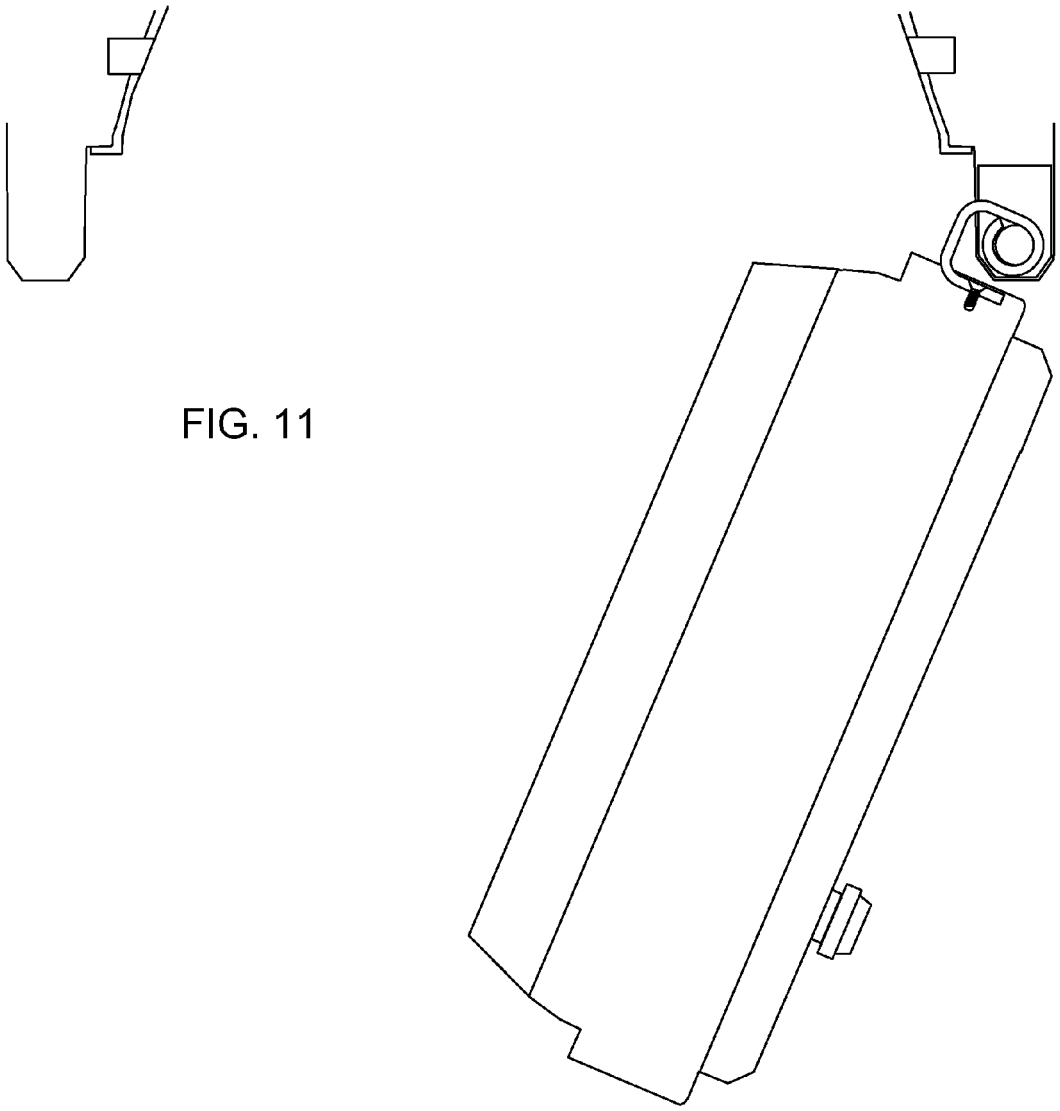

In FIG. 7, the user has turned handle 5 ninety degrees counter clockwise, causing bolts 25 to withdraw from recesses 26 so that the safe door 2 can be opened by pulling on handle 5.

FIGS. 8-11 show safe door 2 in the process of being opened to allow access into the inside of safe body 3.

Front Surface of Door Frame is Continuous

As viewed best in FIG. 1, door frame 6 is continuous and without any interruption at its front surface showing a hinge connection. This feature is not present in prior art safe door frames. For safe 1, hinge lugs 15 and 16 (FIG. 4) connect to hinge pins 10 and 11 through the rear portion of the inner side of frame 6. This makes it very difficult to improperly tamper with hinge lugs 15 and 16 and vastly improves the security of safe 1.

Other Preferred Embodiment

Figure 12:
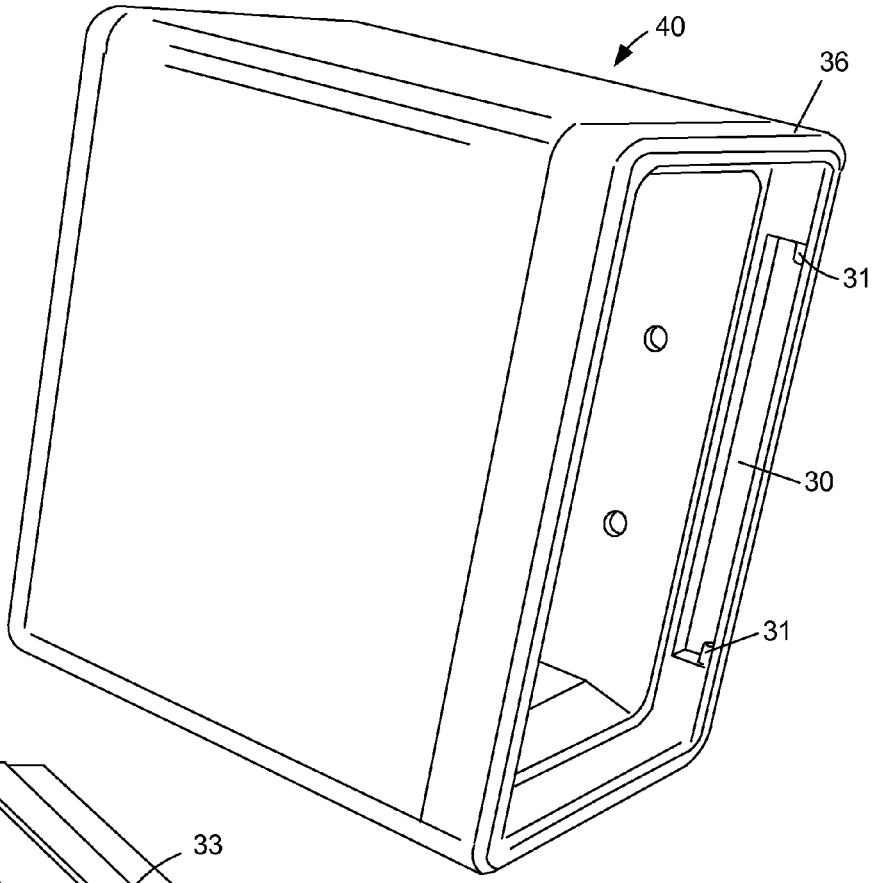
FIGS. 12-13 show another preferred embodiment of the present invention.
Figure 13:
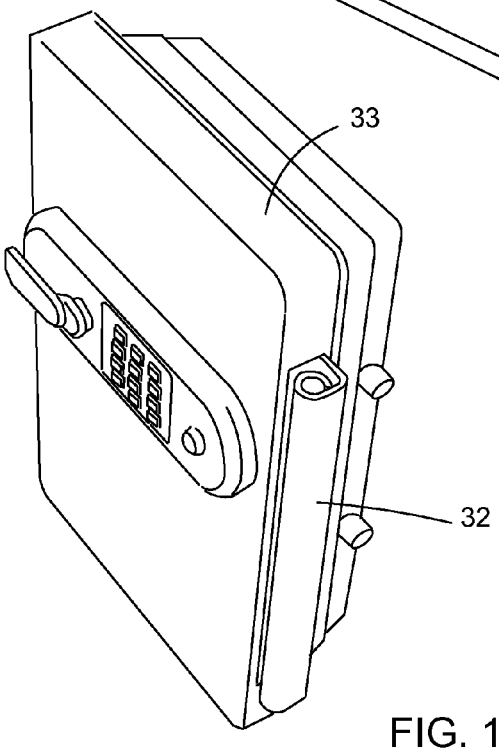

FIGS. 12 and 13 show another preferred embodiment of the present invention. In FIGS. 12-13 it is shown that it is possible to modify the number of pockets and hinge lugs. In the embodiment shown in FIGS. 12 and 13, safe 40 utilizes safe door frame 36 that includes just one pocket 30. Pocket 30 includes hinge pins 31. One hinge lug 32 is rigidly connected to safe door 33. In a preferred embodiment hinge pins 31 are spring loaded.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

What is claimed is:

1. A safe having at least one concealed hinge assembly, comprising:

A. a safe body, comprising:

i. at least one hinge pocket, located within a portion of a wall of the safe body along an inside surface of the wall and having no opening except a single opening, defining a pocket opening, which is completely covered by a surface of the safe door when the safe door is closed, said at least one hinge pocket comprising:

a. a horizontal bottom extending inward from the front edge of said safe, b. a vertical back parallel to the front edge of said safe, c. a horizontal top parallel to said horizontal bottom, ii. at least one hinge pin within the hinge pocket and connected to said horizontal bottom, and B. at least one hinge lug rigidly attached to a side wall of the safe door and adapted to extend through said pocket opening and form a hinge assembly when said at least one hinge pin is inserted through said at least one hinge lug in order to pivotally attach the safe door to the safe body;

wherein said at least one hinge lug is positioned on the side wall in manner so that when the safe door is closed, the side wall of the safe door completely covers the pocket opening of the at least one hinge pocket so that said at least one hinge assemble in addition to being concealed within the safe body is also completely concealed and contained within the at least one hinge pocket, separated from other locations inside the safe and protected from tampering by thieves gaining access to the other locations inside the safe.

2. The safe as in claim 1, further comprising a door frame rigidly connected to said safe body becoming part of the safe body, wherein said at least one pocket is contained within said door frame.

3. The safe as in claim 2, wherein said door frame is continuous and without interruption at its front surface.

4. The safe as in claim 1 wherein said at least one pocket is two pockets, each of said two pockets comprising said at least one hinge pin, and wherein said at least one hinge lug is two hinge lugs.

5. The safe as in claim 1, wherein said at least one hinge pin is at least one spring loaded hinge pin.

6. The safe as in claim 1, wherein said pocket is a recessed pocket.

7. A safe, comprising:

A. a safe body means, and a safe door for protecting a hinge assembly from tampering by providing at least one hinge pocket located within a wall of the safe body along an inside surface of the wall, said safe body means comprising:

i. at least one pocket means having no opening except a single pocket opening, which is completely covered by a surface of the safe door when the safe door is closed, said at least one hinge pocket means comprising:

a. a horizontal bottom extending inward from the front edge of said safe, b. a vertical back parallel to the front edge of said safe, c. a horizontal top parallel to said horizontal bottom, ii. at least one hinge pin means attached to said horizontal bottom, and B. a lug means attached to a side wall of the safe door adapted to be attached to the at least one hinge pin means to provide the hinge assembly which is, when the safe door is closed, completely concealed within the at least one hinge pocket means with the pocket opening being completely covered by the side wall of the safe door, so that the hinge assembly is concealed and protected from tampering when the safe door is closed, by being completely contained inside the safe body and by being completely concealed and contained inside the hinge pocket and protected from tampering by thieves gaining access to other locations inside the safe.

8. The safe as in claim 7, further comprising a door frame means rigidly connected to said safe body means, wherein said at least one pocket means is recessed contained within said door frame means.

9. The safe as in claim 8, wherein said door frame means is continuous and without interruption at its front surface for a hinge connection.

10. The safe as in claim 9, wherein said at least one hinge lug means connects to said at least one hinge pin means at the rear portion of the inner side of said door frame means.

11. The safe as in claim 7 wherein said at least one pocket means is two pockets, each of said two pockets comprising said at least one hinge pin means, and wherein said at least one hinge lug means is two hinge lugs.

12. The safe as in claim 7, wherein said at least one hinge pin means is at least one spring loaded hinge pin.

13. The safe as in claim 7, wherein said pocket means is a recessed pocket means.

* * * * *